US009987857B2

(12) United States Patent
Moriyama et al.

(10) Patent No.: US 9,987,857 B2
(45) Date of Patent: Jun. 5, 2018

(54) PRINTING DEVICE, AND PRINTING METHOD

(71) Applicant: Seiko Epson Corporation, Tokyo (JP)

(72) Inventors: Ryuji Moriyama, Matsumoto (JP); Hiroyuki Maeda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/349,507

(22) Filed: Nov. 11, 2016

(65) Prior Publication Data

US 2017/0129259 A1 May 11, 2017

(30) Foreign Application Priority Data

Nov. 11, 2015 (JP) ..... 2015-221003

(51) Int. Cl.
*B41J 3/28* (2006.01)
*B41J 11/50* (2006.01)
*B41J 13/28* (2006.01)

(52) U.S. Cl.
CPC ..... *B41J 3/283* (2013.01); *B41J 11/50* (2013.01); *B41J 13/28* (2013.01)

(58) Field of Classification Search
CPC ..... B41J 3/283; B41J 11/50; B41J 13/28
See application file for complete search history.

(56) References Cited

U.S. PATENT DOCUMENTS 8,770,876 B2 7/2014 Fukusada et al.
9,180,685 B1 * 11/2015 Masuda ..... B41J 3/28
2007/0222846 A1 * 9/2007 Nakamura ..... B41J 3/60 347/104
2010/0150631 A1 * 6/2010 Kobayashi ..... B65H 5/062 399/395
2010/0230889 A1 * 9/2010 Eoka ..... B41J 3/283 271/3.14
2011/0215524 A1 * 9/2011 Inoue ..... B65H 7/08 271/228

FOREIGN PATENT DOCUMENTS

JP 62-235151 A 10/1987
JP 02-198954 A 8/1990
JP 06-271152 A 9/1994
JP 3920017 B2 5/2007
JP 5327209 B2 10/2013
JP 5505635 B2 5/2014

* cited by examiner

*Primary Examiner* — Alessandro Amari
*Assistant Examiner* — Roger W Pisha, II
(74) *Attorney, Agent, or Firm* — Nutter McClennen & Fish LLP; John J. Penny, Jr.

(57) ABSTRACT

A printing device including: a first conveyance path and a second conveyance path configured to conveying print media; a skew correction unit configured to correct skewing of the print medium conveyed along the first conveyance path; and a print unit configured to print on the print medium conveyed on the first conveyance path or the second conveyance path; the first conveyance path and the second conveyance path merging downstream of the skew correction unit; print media conveyed from the second conveyance path.

12 Claims, 2 Drawing Sheets

PRINTING DEVICE, AND PRINTING METHOD

Priority is claimed under 35 U.S.C. § 119 to Japanese Application no. 2015-221003 filed on Nov. 11, 2015 which is hereby incorporated by reference in their entirety.

BACKGROUND

1. Technical Field

The present disclosure relates to a printing device to which print media can be supplied from multiple conveyance paths, and more specifically relates to a printing device capable of reliably preventing collisions between print media and controlling print media conveyance appropriately to the situation.

2. Related Art

Manual feed printers are often used to print booklets such as bank passbooks. Such manual feed printers have an opening provided in the front for a user to insert a print medium such as a passbook. The print medium is then ejected from the opening (the insertion opening) after printing. The printer may also have a means for correcting skewing of the inserted print medium.

Ideally this kind of printer is provided with a conveyance path other than the path for manually inserting print media, can print to other types of print media such as paper rolls or precut sheets, and has a variety of print functions.

However, a way to prevent print media from colliding at a junction of the conveyance paths in a printer having multiple print media conveyance paths.

In a printer having a main feed section and a manual feed section, JP-A-H06-271152 proposes providing a locking mechanism that prevents releasing the manual feed table to prevent print media from both routes from overlapping.

In a manual feed printer having a function for correcting skewing of the print medium as described above, the print medium conveyance roller in the skew correction unit usually also functions as a feed roller that feeds the print medium to the print position. When such a printer is provided with a second print media conveyance path, the junction of the manual-feed conveyance path and the second conveyance path is generally designed to be upstream from the skew correction unit that also functions as a feed roller.

However, a magnetic reader is often provided between the print medium insertion opening and the junction in this type of printer, and because of the distance between the insertion opening and the junction, the user is unable to see junction. Consequently, the user may insert a passbook or other print medium into the insertion opening without seeing that another print medium is being supplied from another conveyance path, and the print media are likely to collide.

Additionally, the skew correction unit requires a member that contacts the print medium to correct any skewing, and this member is implemented as a shutter (gate) capable of opening and closing the conveyance path downstream of the conveyance roller. When executing the printing process on print media supplied from the other conveyance path, the shutter must be open to supply the print medium to the print position because of the location of the junction. Therefore, when inserting a passbook or other print medium from the manual insertion opening, the user may mistakenly shove the print medium past (downstream of) the shutter even when no other print medium is at the junction.

Moreover, when the print medium from the other conveyance path exits from the front, the print medium inserted from the insertion slot and the print medium being ejected may also collide.

The technology described in JP-A H06-271152 cannot solve this problem.

The disclosure is directed to a printing device in which print media can be supplied from multiple conveyance paths and which can reliably prevent collisions between print media and control print media conveyance appropriately to the situation.

SUMMARY

To achieve the above object, a printing device according to one aspect of the present disclosure includes a first conveyance path and a second conveyance path configured to conveying print media; a skew correction unit configured to correct skewing of the print medium conveyed along the first conveyance path; and a print unit configured to print on the print medium conveyed on the first conveyance path or the second conveyance path; the first conveyance path and the second conveyance path merging downstream of the skew correction unit; print media conveyed from the second conveyance path.

This configuration can reliably prevent the print medium supplied from the second conveyance path from colliding with or overlapping print media inserted to the first conveyance path because the shutter is closed when printing using the second conveyance path.

Further preferably in another aspect of the disclosure, if print media is inserted to the first conveyance path while printing on print media conveyed from the second conveyance path, the skew correction unit corrects skewing of the print medium inserted to the first conveyance path.

By correcting skewing of the print medium inserted to the first conveyance path while the print medium conveyed from the second conveyance path is being printed, this configuration can quickly start printing on the print medium inserted to the first conveyance path.

Further preferably, the printing device also has a print media exit downstream of the skew correction unit, and if print media is inserted to the first conveyance path while printing on a print medium conveyed from the second conveyance path, discharges the print medium being printed from the paper exit.

This configuration can control print media conveyance appropriately to the situation.

To achieve the above object, another aspect of the present disclosure is a control method of a printing device including a first conveyance path and a second conveyance path configured to conveying print media; a skew correction unit configured to correct skewing of the print medium conveyed along the first conveyance path; and a print unit configured to print on the print medium conveyed on the first conveyance path or the second conveyance path; the first conveyance path and the second conveyance path merging downstream of the skew correction unit, and the skew correction unit having a shutter that opens and closes the first conveyance path; and the control method including the shutter closing the first conveyance path when printing to a print medium conveyed from the second conveyance path.

Additional objects and features of the disclosure will be apparent from the following description of an embodiment of the disclosure.

DESCRIPTION OF EMBODIMENTS

Figure 1:
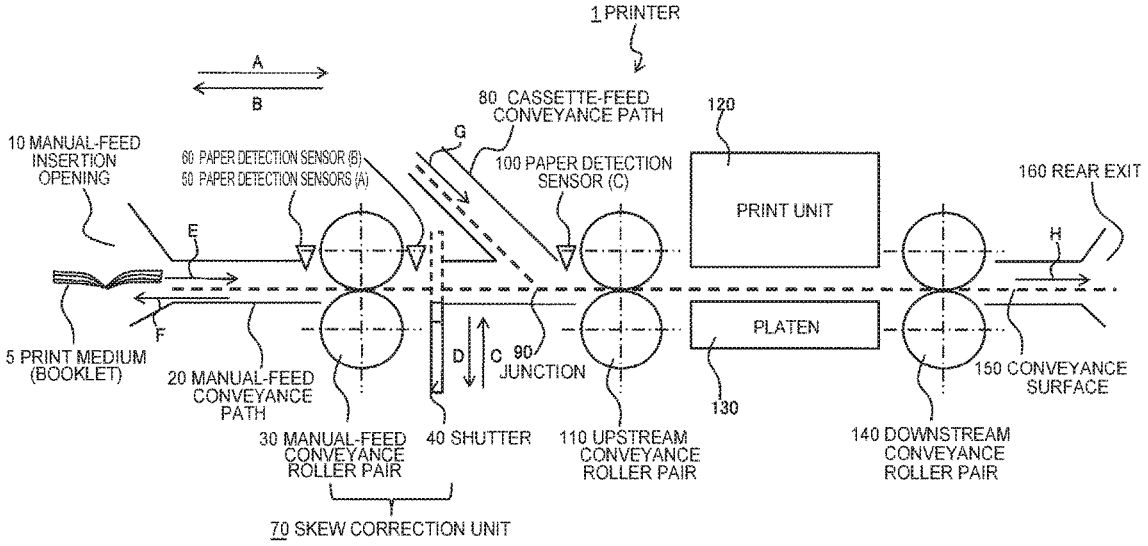
FIG. 1 is a schematic side view of a printing device according to the disclosure.

A preferred embodiment of the present disclosure is described below with reference to the drawings. However the embodiment described is not intended to limit the technical scope of the disclosure. Note that in the drawings, the same or similar elements are described using the same reference numerals or the same symbols.

FIG. 1 is a schematic side view of an embodiment of a printing device according to the disclosure. The printer 1 according to the disclosure as shown in FIG. 1 has a manual-feed conveyance path 20 (first conveyance path) for manual printing, and a cassette-feed conveyance path 80 (second conveyance path) for feeding paper from a paper cassette. The printer 1 is also provided with a skew correction unit 70 (skew correction device) on the manual-feed conveyance path 20, and the manual-feed conveyance path 20 and the cassette-feed conveyance path 80 merge downstream from the skew correction unit 70. The shutter 40 of the skew correction unit 70 is closed when printing on media from the cassette-feed conveyance path 80. Therefore, the printer 1 can reliably prevent the collision of print media (such as a passbook or other booklet and precut sheets), supplied from multiple conveyance paths, and the printer can print on various kinds of print media.

In one example, the printer 1 is an inkjet passbook printer such as used at a bank. As described above, the printer 1 has two conveyance paths (20, 80) as conveyance paths for the print media 5. As illustrated in FIG. 1, to print on a passbook as the print medium 5 (booklet), the print medium 5 is inserted (in the direction of arrow E in FIG. 1) by the user from the front (the left side in FIG. 1) of the printer 1, and after printing the print medium 5 is returned to and ejected from the insertion location (in the direction of the arrow F in FIG. 1). To print to print media 5 (precut sheet) stored in a paper cassette (not shown), the print medium 5 is fed in the direction of the arrow G in FIG. 1, and after printing the print medium 5 (precut sheet) may be ejected from the front (in the direction of the arrow F in FIG. 1) or the rear (in the direction of the arrow H in FIG. 1).

FIG. 1 is a general side view of the configuration of the printer 1, and in particular illustrates the conveyance routes for the print medium 5 (the booklet or the precut sheet). Parts of the printer 1 are described below with reference to FIG. 1. Note that in FIG. 1 arrow A represents the normal conveyance direction of the print medium 5, and the arrow B represents the reverse conveyance direction of the print medium 5.

To manually print on the print medium 5 (booklet), a manual-feed insertion opening 10 (entrance) is provided at the front of the printer 1 for manually inserting the print medium 5 (booklet). The print medium 5 (booklet) is inserted to the manual-feed insertion opening 10. Note that, as described above, the manual-feed insertion opening 10 is also the paper exit when the printer 1 ejects the print medium from the front.

The manual-feed conveyance path 20 is the conveyance path that carries print media 5 (booklet) inserted from the manual-feed insertion opening 10 to the print position. When discharged to the front, the manual-feed conveyance path 20 is the path carrying the print medium 5 in the reverse direction.

The skew correction unit 70 corrects skewing of the print medium 5 (booklet) inserted from the manual-feed insertion opening 10, and includes a manual-feed conveyance roller pair 30, the shutter 40, a paper detection sensor (A) 50, and paper detection sensors (B) 60.

The manual-feed conveyance roller pair 30 is a pair of rollers that convey the inserted print medium 5 (booklet) forward, and is powered by a drive mechanism (such as a motor and power transfer device) not shown. The manual-feed conveyance roller pair 30 can also be driven in reverse, and conveys the printed print medium 5 in reverse to discharge the print medium 5.

The shutter 40 is a bumper (plate) capable of moving vertically (in the direction of arrows C, D in FIG. 1), and is powered by a drive mechanism (such as a motor and power transfer device) not shown. The shutter 40 is raised (depicted by the dotted lines in FIG. 1) when correcting skewing of the print medium 5 (booklet) and blocks (closes off) the conveyance path. By driving the manual-feed conveyance roller pair 30 in the forward direction, the print medium 5 (booklet) contacts the shutter 40 and skewing of the print medium 5 (booklet) is corrected.

The shutter 40 is lowered (the location depicted by the solid line in FIG. 1) to open the conveyance path when conveying the print medium 5 (booklet) to the print position, and when ejecting the print medium 5 from the manual-feed insertion opening 10. When printing using the cassette-feed conveyance path 80, the shutter 40 is raised to block (close) the conveyance path.

The paper detection sensor (A) 50 and the paper detection sensors (B) 60 are sensors for detecting the presence of a print medium 5, and are respectively provided before (upstream) and after (downstream) the manual-feed conveyance roller pair 30. To check that skewing of the print medium 5 (booklet) has been corrected, multiple paper detection sensors (B) 60 are provided perpendicularly to the width (the conveyance direction (arrows A, B in FIG. 1)) of the print medium 5 (booklet) and the vertical axis (indicated by arrows C, D in FIG. 1). Sensors known from the literature may be used for paper detection sensor (A) 50 and paper detection sensors (B) 60.

Although not illustrated in FIG. 1, a magnetic reader may be disposed to the manual-feed conveyance path 20 between the manual-feed insertion opening 10 and the manual-feed conveyance roller pair 30 for reading magnetic information from the inserted print medium 5 (booklet).

The cassette-feed conveyance path 80 is a conveyance path that carries print media 5 (precut sheets) supplied from a paper cassette not shown. The paper cassette is disposed at the upstream end of (the upstream side of arrow G) of the cassette-feed conveyance path 80 (FIG. 1). In the forward conveyance direction, the cassette-feed conveyance path 80 merges with the manual-feed conveyance path 20 downstream of the skew correction unit 70 (the shutter 40). More specifically, the manual-feed conveyance path 20 and the cassette-feed conveyance path 80 merge at junction 90 in FIG. 1.

An upstream conveyance roller pair 110 is a pair of rollers that conveys a print medium 5 supplied from the manual-feed conveyance path 20 or the cassette-feed conveyance path 80 in the forward direction and supplies the print medium 5 to the print position (the location of the print unit 120), and is powered by a drive mechanism (such as a motor and power transfer mechanism) not shown. The upstream conveyance roller pair 110 can also be driven in reverse, and when ejecting the print medium 5 conveys the printed print medium 5 in reverse.

A paper detection sensor (C) 100 is a sensor that detects the presence of a print medium 5 and is disposed in before (upstream) of the upstream conveyance roller pair 110 in the conveyance direction. Sensors known from the literature may be used for the paper detection sensor (C) 100.

The print unit 120 is the part that prints on the print medium 5 (a booklet or a precut sheet) supplied on the conveyance surface 150 by the upstream conveyance roller pair 110, and has multiple nozzles for ejecting ink.

A platen 130 is disposed opposite the print unit 120 with the print medium 5 therebetween.

The downstream conveyance roller pair 140 is a pair of rollers that conveys the printed print medium 5 (booklet) in the forward conveyance direction, and is powered by a drive mechanism (such as a motor and power transfer device) not shown. The downstream conveyance roller pair 140 can also be driven in reverse, and when ejecting the print medium 5 conveys the printed print medium 5 in reverse.

A rear exit 160 (print media exit) is used when the printed print medium 5 cannot be ejected from the front (manual-feed insertion opening 10).

The printer 1 also has with a controller (not shown in FIG. 1). The controller controls the printing process of the print unit 120 and conveyance of the print medium 5. To control media conveyance, the controller controls operation of each roller pair 30, 110, 140, and the shutter 40 on the basis of the detection results from paper detection sensor (A) 50, paper detection sensors (B) 60, and paper detection sensor (C) 100. The controller may comprise a CPU, RAM, ROM, ASIC, or firmware (program), for example.

The printer 1 thus comprised conveys print media 5 as described below.

First, during manual feed printing, the user (operator) inserts a print medium 5 (booklet) from the manual-feed insertion opening 10 in the direction of arrow E (FIG. 1). When the paper detection sensor (A) 50 detects that a print medium 5 (booklet) is inserted, the controller raises the shutter 40 to block (close) the manual-feed conveyance path 20 and drives the manual-feed conveyance roller pair 30.

Driving the manual-feed conveyance roller pair 30 causes the print medium 5 (booklet) to bump into the shutter 40, and skewing is corrected. Once the controller determines that skew correction is complete based on the results from the paper detection sensors (B) 60, the controller lowers the shutter 40 to open the manual-feed conveyance path 20.

The print medium 5 (booklet) is conveyed in forward as the manual-feed conveyance roller pair 30 is driven, and is detected by the paper detection sensor (C) 100. When the print medium 5 is detected, the controller drives the upstream conveyance roller pair 110 and the downstream conveyance roller pair 140 and conveys the print medium 5 (booklet) in the forward direction.

The print medium 5 (booklet) is thus supplied to the print position and the print unit 120 then prints on the print medium 5 (booklet).

Once printing is complete, the controller drives the upstream conveyance roller pair 110, the downstream conveyance roller pair 140, and the manual-feed conveyance roller pair 30 in reverse to convey the print medium 5 (booklet) in reverse. The print medium 5 (booklet) passes over the open shutter 40 moving in the direction of arrow F (FIG. 1) along the manual-feed conveyance path 20 and exits from the manual-feed insertion opening 10.

Figure 2:
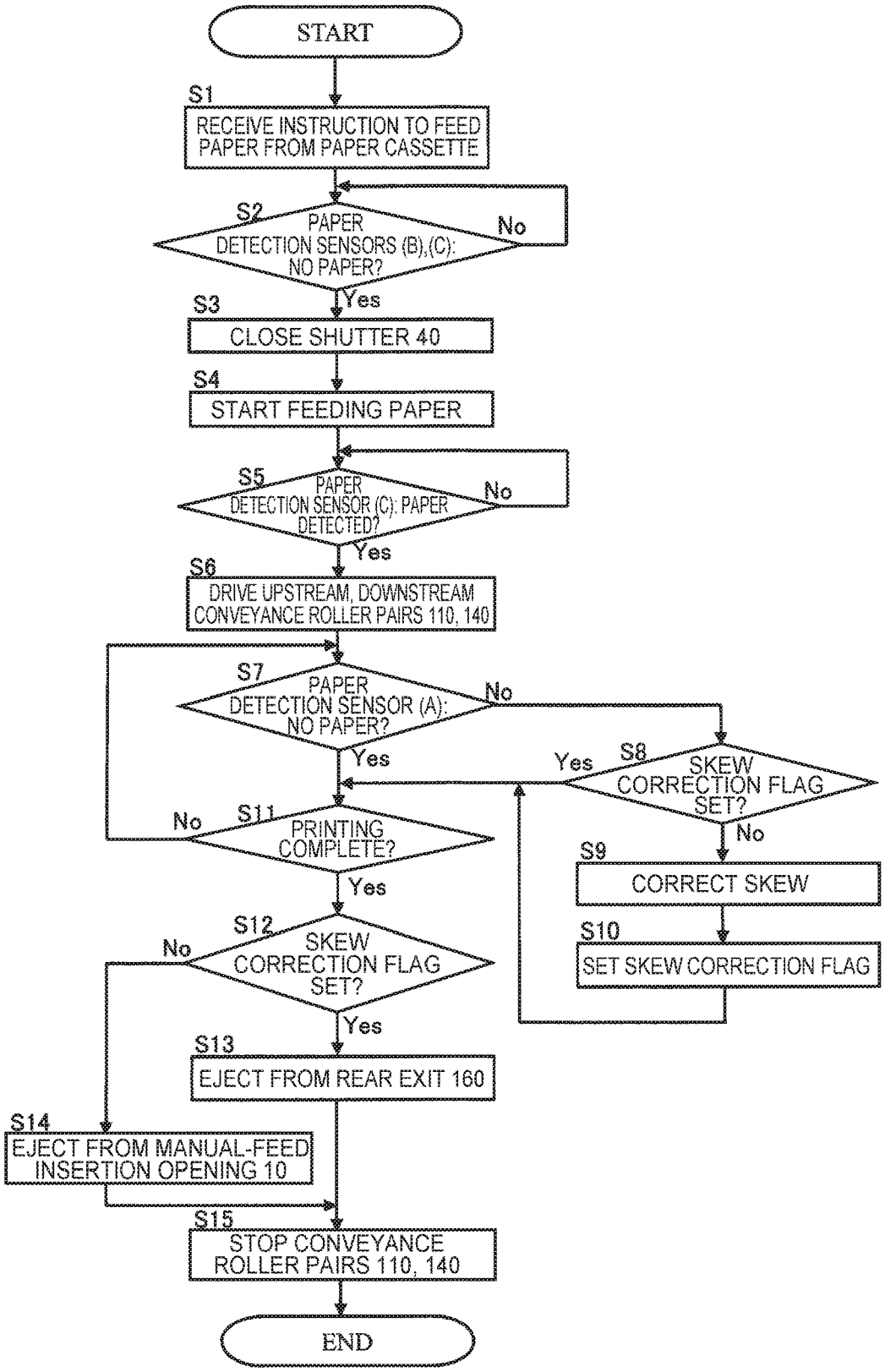
FIG. 2 is a flow chart of the conveyance control process when using a paper cassette.

Conveyance of the print medium 5 (precut sheet) is controlled as described below when printing to a print medium 5 (precut sheet) conveyed from the cassette-feed conveyance path 80. FIG. 2 is a flow chart showing an example of the conveyance control process when printing from a paper cassette.

On receiving an instruction to feed paper from the paper cassette (step S1 in FIG. 2), the controller checks whether or not the detection values from the paper detection sensors (B) 60 and the paper detection sensor (C) 100 indicate "No Paper" (step S2 in FIG. 2). If the detection value from either of the paper detection sensors indicates "Paper Present" (No, step S2 in FIG. 2), the controller determines that the print medium 5 is at the paper detection sensors (B) 60 or the paper detection sensor (C) 100, and waits before feeding paper from the paper cassette.

When the detection values from both of the paper detection sensors indicates "No Paper" (Yes, step S2 in FIG. 2), the controller determines that no print medium 5 is at the paper detection sensors (B) 60 or the paper detection sensor (C) 100, and closes the shutter 40 to close the manual-feed conveyance path 20 (step S3 in FIG. 2).

The controller then begins feeding paper from the paper cassette (step S4 in FIG. 2). When the detection value from the paper detection sensor (C) 100 indicates "Paper Present" (Yes step S5 in FIG. 2), the controller determines that the print medium 5 (precut sheet) from the paper cassette has been conveyed up to the paper detection sensor (C) 100, and drives the upstream conveyance roller pair 110 and the downstream conveyance roller pair 140 (step S6 in FIG. 2).

The print medium 5 (precut sheet) is then conveyed to the print position, and processed by print unit 120. The controller periodically checks the detection value from the paper detection sensor (A) 50 (step S7 in FIG. 2) until the printing process is complete (No, at step S11 in FIG. 2).

If the detection value from the paper detection sensor (A) indicates "No Paper" (Yes at step S7 in FIG. 2), the controller determines no print medium 5 (booklet) was inserted from the manual-feed insertion opening 10 and takes no particular action.

If the detection value of the paper detection sensor (A) indicates "Paper Present" (No at step S7 in FIG. 2), the controller determines that a print medium 5 (booklet) was inserted from the manual-feed insertion opening 10 and determines whether a skew correction flag is set (step S8 in FIG. 2). The skew correction flag is set (stored) when a skew correction process is run (completed) in step S9 described below.

The controller takes no particular action if the skew correction flag is set (is stored; Yes at step S8). Processing then returns to step S11.

However, if the skew correction flag is not set (is not stored) (No at step S8 in FIG. 2), the controller runs a skew correction process (step S9 in FIG. 2). More specifically, the manual-feed conveyance roller pair 30 conveys the print medium 5 (booklet) at the paper detection sensor (A) 50 forward until the print medium 5 (booklet) contacts the shutter 40, which is closed. Once the controller determines from the paper detection sensors (B) 60 that skew correction is complete, the controller sets (stores) the skew correction flag (step S10 in FIG. 2). Processing then returns to step S11.

Once the printing process ends (Yes at step S11 in FIG. 2), the controller determines which exit to eject the printed print medium 5 (precut sheet) from based on whether or not the skew correction flag is set. More specifically, if the skew correction flag is set (Yes at step S12 in FIG. 2), the controller determines that a print medium 5 (booklet) is on the manual-feed conveyance path 20 waiting to be printed, and selects the rear exit 160. If the skew correction flag is not set (No at step S12 in FIG. 2), the controller determines there is no print medium 5 (booklet) on the manual-feed conveyance path 20 and selects the manual-feed insertion opening 10.

When the rear exit 160 is selected, the controller continues to drive the upstream conveyance roller pair 110 and the downstream conveyance roller pair 140 in the forward direction, and ejects the printed print medium 5 (precut sheet) from the rear exit 160 (step S13 in FIG. 2).

When the manual-feed insertion opening 10 is selected, the controller drives the upstream conveyance roller pair 110 and the downstream conveyance roller pair 140 in reverse and opens the shutter 40 to open the manual-feed conveyance path 20. The controller then drives the manual-feed conveyance roller pair 30 in reverse to eject the printed print medium 5 (precut sheet) from the manual-feed insertion opening 10.

In either case, once the media has been ejected, the controller stops driving the conveyance roller pairs and resets the skew correction flag (step S15 in FIG. 2). This completes conveyance control when the print medium is supplied from the paper cassette ends.

This embodiment describes a configuration having a conveyance path from a paper cassette (cassette-feed conveyance path 80) as a conveyance path separate from the manual-feed conveyance path 20, but instead of or in addition thereto may have a conveyance path for feeding a print medium 5 stored as a roll. In this case, the manual-feed conveyance path 20 and the separate feed path will also merge downstream from the shutter 40, and conveyance of the print media is controlled in the same manner as described based on FIG. 2 when feeding the print unit from the separate feed path.

As described above, in a printer 1 according to this embodiment, the junction 90 where the manual-feed conveyance path 20 and the cassette-feed conveyance path 80 merge is downstream of the skew correction unit 70 (shutter 40) in the forward conveyance direction, and because the shutter 40 is closed when printing using the cassette-feed conveyance path 80, print media 5 (precut sheet) supplied from the paper cassette can be reliably prevented from colliding or overlapping with a print medium 5 (booklet) inserted by the operator from the manual-feed insertion opening 10.

Providing a new shutter to prevent print media 5 collisions is also not necessary.

When the user inserts a print medium 5 (booklet) from the manual-feed insertion opening 10 while printing using the cassette-feed conveyance path 80, skewing of the inserted print medium 5 (booklet) is corrected while printing, and the print unit can then quickly transition to printing the inserted print medium 5 (booklet).

Finally, when a print medium 5 (booklet) is inserted from the manual-feed insertion opening 10 while printing using the cassette-feed conveyance path 80, conveyance is controlled so that the print medium 5 (precut sheet) supplied from the cassette-feed conveyance path 80 is ejected from a rear exit 160, and conveyance can be controlled appropriately to the situation.

The printer 1 can thus print to various kinds of media with no problems.

The scope of the disclosure is not limited to the foregoing embodiment, and includes the disclosure described in the accompanying claims and equivalents thereof.

What is claimed is:

1. A printing device comprising:

a first conveyance path configured to convey a first print medium and a second conveyance path configured to convey a second print medium;

a skew correction unit configured to correct skewing of the first print medium conveyed along the first conveyance path, the skew correction unit comprising a shutter that opens and closes the first conveyance path; and a print unit configured to print on the first print medium conveyed on the first conveyance path and the second print medium conveyed on the second conveyance path, wherein the first conveyance path and the second conveyance path merge at a junction between the skew correction unit and the print unit, and wherein the shutter of the skew correction unit closes the first conveyance path for conveying the first print medium in response to an instruction to convey the second print medium on the second conveyance path for printing, and thereby preventing the first print medium from colliding with the second print medium at the junction between the skew correction unit and the print unit.

2. The printing device of claim 1, wherein the first print medium conveyed along the first conveyance path is conveyed towards the closed shutter, contacts the closed shutter, and skewing is corrected.

3. The printing device of claim 1, wherein if the first print medium is inserted to the first conveyance path while printing on the second print medium conveyed from the second conveyance path, the skew correction unit corrects skewing of the first print medium inserted to the first conveyance path.

4. The printing device of claim 3, wherein the first print medium is inserted to the first conveyance path and corrected for skew is printed after printing to the second print medium conveyed from the second conveyance path ends.

5. The printing device of claim 1, further comprising:

a print media exit downstream of the skew correction unit;

wherein if the first print medium is inserted to the first conveyance path while printing on the second print medium conveyed from the second conveyance path, the second print medium being printed is discharged from the print media exit.

6. The printing device of claim 5, wherein the first conveyance path includes an entrance through which the first print medium is inserted to the first conveyance path; and if the first print medium is not inserted to the first conveyance path while printing on the second print medium conveyed from the second conveyance path, the second print medium being printed is discharged to the entrance from the first conveyance path.

7. A method of controlling a printing device including a skew correction unit and a print unit, the skew correction unit having a shutter that opens and closes a first conveyance path to the print unit, the method comprising:

conveying a first print medium on the first conveyance path to the print unit; and conveying a second print medium on a second conveyance path to the print unit, wherein the first conveyance path and the second conveyance path merge at a junction between the skew correction unit and the print unit, wherein the shutter of the skew correction unit closes the first conveyance path for conveying the first print medium in response to an instruction to convey the second print medium on the second conveyance path, and thereby preventing the first print medium from colliding with the second print medium at the junction between the shutter and the print unit.

8. The method of claim 7, wherein further comprising correcting skewing of the first print medium by conveying the first print medium towards the closed shutter and pushing the first print medium against the closed shutter.

9. The method of claim 7, wherein further comprising if the first print medium is inserted to the first conveyance path while printing on the second print medium conveyed from the second conveyance path, correcting skewing of the first print medium inserted to the first conveyance path.

10. The method of claim 9, wherein printing on the first print medium inserted to the first conveyance path and corrected for skew after printing on the second print medium conveyed from the second conveyance path ends.

11. The method of claim 7, wherein the printing device has a print media exit downstream of the skew correction unit, the method further comprising:

if the first print medium is inserted to the first conveyance path while printing on the second print medium conveyed from the second conveyance path, discharging the second print medium being printed from the print media exit.

12. The method of claim 11, wherein the first conveyance path includes an entrance through which the first print medium is inserted to the first conveyance path, the method further comprising:

if the first print medium is not inserted to the first conveyance path while printing on the second print medium conveyed from the second conveyance path, discharging the second print medium being printed to the entrance from the first conveyance path.

* * * * *